US009464802B2

(12) United States Patent
Inan et al.

(10) Patent No.: US 9,464,802 B2
(45) Date of Patent: Oct. 11, 2016

(54) FLOW CONTROLLED EFFECTIVE LED BASED LIGHTING SYSTEM

(71) Applicants: Muhammed Nasir Inan, Istanbul (TR); Mehmet Arik, Istanbul (TR)

(72) Inventors: Muhammed Nasir Inan, Istanbul (TR); Mehmet Arik, Istanbul (TR)

(73) Assignee: OZYEGIN UNIVERSITESI, Istanbul (TR)

( * ) Notice: Subject to any disclaimer, the term of this patent is extended or adjusted under 35 U.S.C. 154(b) by 236 days.

(21) Appl. No.: 14/183,931

(22) Filed: Feb. 19, 2014

(65) Prior Publication Data

US 2015/0233571 A1 Aug. 20, 2015

(51) Int. Cl.

| | |
|---|---|
| ***F21V 29/00*** | (2015.01) |
| ***F21V 29/83*** | (2015.01) |
| ***F21K 99/00*** | (2016.01) |
| ***F21V 23/00*** | (2015.01) |
| ***F21V 29/503*** | (2015.01) |
| ***F21V 9/16*** | (2006.01) |
| ***F21V 29/77*** | (2015.01) |
| *F21Y 101/02* | (2006.01) |
| *F21Y 101/00* | (2016.01) |

(52) U.S. Cl.

CPC ..... *F21V 29/83* (2015.01); *F21K 9/232* (2016.08); *F21K 9/56* (2013.01); *F21K 9/64* (2016.08); *F21V 9/16* (2013.01); *F21V 23/006* (2013.01); *F21V 23/009* (2013.01); *F21V 29/503* (2015.01); *F21V 29/77* (2015.01); *F21Y 2101/00* (2013.01); *F21Y 2101/02* (2013.01); *F21Y 2107/40* (2016.08); *F21Y 2115/10* (2016.08)

(58) Field of Classification Search

CPC .... F21V 29/004; F21V 29/503; F21V 29/70; F21V 29/74; F21V 29/83; H01L 33/642

See application file for complete search history.

(56) References Cited

U.S. PATENT DOCUMENTS

| | | | | |
|---|---|---|---|---|
| 2005/0174780 | A1* | 8/2005 | Park | F21K 9/135 362/294 |
| 2009/0283779 | A1* | 11/2009 | Negley | F21K 9/00 257/88 |
| 2010/0207502 | A1* | 8/2010 | Cao | F21K 9/135 313/46 |
| 2010/0214781 | A1* | 8/2010 | Chiu | F21V 3/02 362/249.06 |
| 2011/0215696 | A1* | 9/2011 | Tong | F21K 9/00 313/46 |
| 2012/0098425 | A1 | 4/2012 | Arik et al. | |
| 2013/0051003 | A1* | 2/2013 | Fan | F21K 9/13 362/231 |

* cited by examiner

*Primary Examiner* — Andrew Coughlin

(74) *Attorney, Agent, or Firm* — Deris Patents & Trademarks Agency

(57) ABSTRACT

A lighting system has a heat sink for removing the heat released by LED chips by means of natural convection and thermal radiation. A center opening formed between air and heat sink fins enables the transfer of heat generated by LEDs, electronic driver circuit and phosphor on said heat sink fins to the flowing air inside and removing from the system, and increases the contact surface of heat sink fins with the air that enables to transfer the heat effectively from heat sink fins to flowing air and also with effective radiative heat transfer. The heat sink has a chimney inlet where air enters into said center opening, on which the PCB and said LED package are positioned, and which interconnects LED package and heat sink, which has an optimized structure and base angle, that maximize the heat removal by natural convection and thermal radiation.

22 Claims, 7 Drawing Sheets

21
2
42
21
2
4
43
2
21
42
41
43
4

FLOW CONTROLLED EFFECTIVE LED BASED LIGHTING SYSTEM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention is related to a lighting system that cools the LED lamps and the lamps in which said system is applied. Within the scope of this patent application, A-line lamps are presented as an example for the application of said concept.

2. Description of Related Art Including Information Disclosed Under 37 CFR 1.97 and 37 CFR 1.98.

Heat sinks are the passive cooling components used for removing the heat released by the electronic devices. That the cooling process is performed in a passive manner means that the unit does not need to be provided with external energy. Heat removal is performed by firstly transmitting heat to the heat sink fins by the heat sink base connected to the heat source and then, by means of convection and radiation into the air through the fins having larger surface area. LED chips or LED packages used in LED lamps and generating light convert the majority of the energy used into heat. The temperature of chip, which increases together with the heat that cannot be removed decreases the amount and quality of the generated light, shortens the lives of chips and may cause failure of LED. A heat sink with the required cooling capacity maintains the chip temperature at a secured level and meanwhile needs to meet the optical, mechanical and aesthetic criteria of LED lamps.

The amount of heat that is released by high-output LED lamps and is required to be removed is also high. That the high amount of heat released by small-sized LEDs is required to be removed and said process is performed by means of cooling components remaining within the limits with defined standards is the primary problem of LED lamps. An A19-class LED lamp which has an equal luminous flux of 17001 m to 100 W incandescent lamp's luminous flux is one of the primary needs of today's market. Similarly, the sizes and weight of heat sinks that allow high luminous flux, will perform the cooling required for LED lamps generating high heat, will be produced in accordance with the present examples, and have sufficiently big surface area push the standardized limits. The original heat sink types that are designed so as to increase the cooling capacity and for example, have chimney effect both push said limits and are generally deprived of optical and aesthetic terms. In addition to meeting the desired light output and distribution, the aesthetic terms are vital in the application in line with the market experiences and user habits. A low weight heat sink that has a high cooling performance, provides the desired luminous flux, has a function suitable for the habits of usage area, and enables the entire system remaining within the defined geometrical limits are not generally present in the current applications. Thanks to the new concept according to the present invention, the cooling air is enabled to perform cooling process, and also is enabled to perform said process for both LED chip and phosphor and driver circuit.

In the systems where active cooling is used, the actively cooled heat sink with fans decreases the reliability of the system and causes extra energy loss. However, in the systems presented as passive, the contact of air with the surfaces is inefficient and heat sink sizes increase according to the ground.

In the prior art, a U.S patent application numbered US2012098425, dated 2010, Oct. 21 and titled "LIGHTING SYSTEM WITH HEAT DISTRIBUTION FACE PLATE" is provided. The lighting systems disclosed in said application comprise a light source and a thermal management system. The thermal management system includes synthetic jet devices, a heat sink and a heat distribution face plate. The synthetic jet devices are arranged in parallel to one and other and are configured to actively cool the lighting system. The heat distribution face plate is configured to radially transfer heat from the light source into the ambient air. Said invention has an active cooling method and cannot provide the maximum performance that may be achieved from passive-cooling heat sink.

As a result of the above mentioned drawbacks and the insufficiencies of the present solutions regarding the subject, an improvement is required to be made in the related technical field.

BRIEF SUMMARY OF THE INVENTION

Developed by being inspired of the present conditions, the present invention aims to solve the above mentioned drawbacks.

Thanks to the lighting system according to the present invention, heat sink, optic structure (LED chip and phosphor-like materials, and diffuser) and electronic circuit members are configured in an integrated manner. Therefore, the cooling fluid washes the surfaces effectively and receives the heat. Therefore, both the weight and size of the heat sink are decreased and it is enabled to cool down the LED chips and other electronic circuit members as the driver in a multi-purpose manner.

The lighting system according to the present invention has a design complementing the optic and aesthetic sides of the lamp as distinct from the present systems using chimney effect, and the form enabling making use of chimney effect increases cooling power and provides the system creating integrity among thereof.

In the lighting system according to the present invention, the heat sink is placed onto the chimney in an angular manner instead of vertical, and the driver circuit is placed on said flow pathway and chimney effect is benefited and thus, the problems that may arise thermally are eliminated.

In the lighting system according to the present invention, the dome-shaped diffuser that protects the chips and is used for diffusing the light is designed in an elliptic manner in accordance with the present lamps and an aesthetic appearance is achieved, and wide-angle light diffusion is achieved in an omni-directional way together with LED packages placed angularly thereunder.

The area covered by the lighting system according to the present invention remains within A19 limits and the lighting system has a low weight.

In the lighting system according to the present invention, the temperature of the chip that determines the luminous efficacy, light quality, system reability and life span are maintained at a lower level when compared to present examples.

In the lighting system according to the present invention, the heat sink also creates an integrated structure. The electronic circuit members (both conventional and ASIC based) is placed in the flow direction of air by means of chimney effect, wherein dual cooling is achieved.

In addition, the structure of the lighting system according to the present invention is also suitable for placing the sensors detecting the light (color and lumen amount) onto the light motor that is placed in front of the heat sink. That is one of the innovative features of heat sink.

In order to achieve the above mentioned objects, a lighting system which comprises the following has been developed:

- a lighting system comprising;
  - LED package where LED chip generating light is placed;
  - phosphor regulating/controlling the light emitted from said LED chip;
  - diffuser that diffuses the light generated by said LED chip;
  - electronic driver circuit bringing the energy it receives from the connection socket to the desired levels for operating said LED chip and limiting the current on said LED chip;
  - connection socket enabling electricity transmission and;
- a heat sink comprising;
  - heat sink fins removing the heat generated by LED chip, electronic driver circuit and phosphor from said LED chip, said electronic driver circuit and said phosphor by means of natural circulation;
  - a center opening formed between air and heat sink fins, enabling the contact of heat generated by LED chip, electronic driver circuit and phosphor on said heat sink fins with the air and removing from the system, and increasing the contact surface of heat sink wings with the air, and brings a high rate of fluid flow through the heat sink fins and effective radiative heat removal; and
  - a chimney inlet that is the area where the air enters into said center opening; and;
- a PCB on which said LED package is placed and which interconnects the LED package and heat sink.

The structural and characteristic features and all the advantages of the present invention will be more clearly understood thanks to the figures below and the detailed description written with reference to those figures; therefore, the evaluation needs to be done by taking said figures and the detailed description into consideration.

DESCRIPTION OF THE PART REFERENCES

Figures 1, 2, 3, 4:
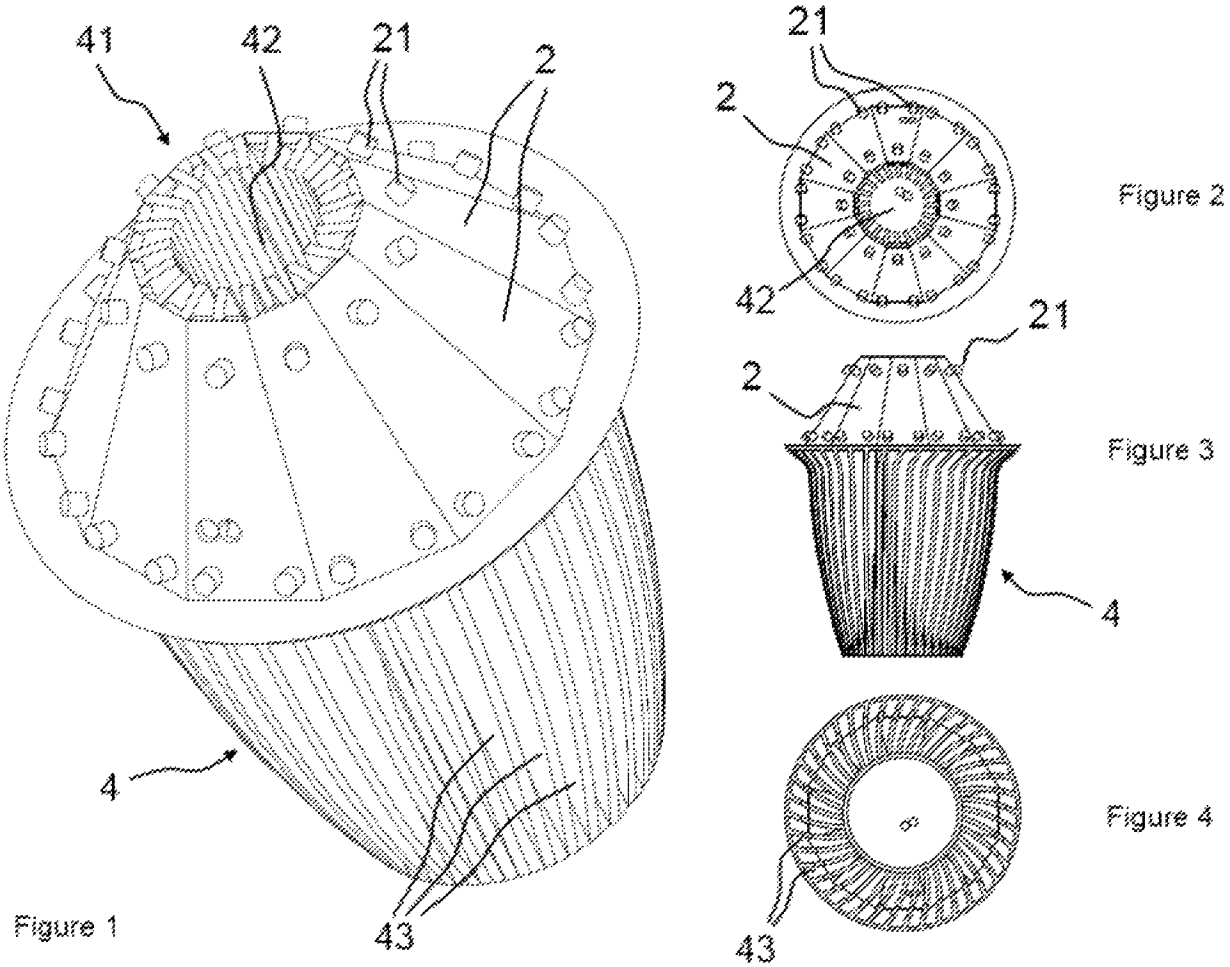
FIG. 1 is the perspective drawing illustrating the preferred embodiment of the lighting system according to the present invention.
FIG. 2 is the two dimensional top drawing illustrating the preferred embodiment of the lighting system according to the present invention.
FIG. 3 is the two dimensional side drawing illustrating the preferred embodiment of the lighting system according to the present invention.
FIG. 4 is the two dimensional bottom drawing illustrating the preferred embodiment of the lighting system according to the present invention.

1. Diffuser
2. Mounting plate
21. Mounting rod
3. PCB
31. LED package
4. Heat sink
41. Chimney inlet
42. Center opening
43. Fins
5. Electronic driver circuit
6. Insulator
7. Connection socket
8. Circuit board housing
9. phosphor
10. Electricity insulation layer The drawings do not need to be scaled necessarily and the details that are not necessary for understanding the present invention may have been ignored. In addition, the members that are at least identical to a great extent or have identical functions to a great extent are referred with the same numeral.

DETAILED DESCRIPTION OF THE INVENTION

In this detailed description, the preferred embodiments of the lighting system according to the present invention are described only for the subject to be understood better.

The lighting system according to the present invention comprises diffuser (1), mounting plate (2), PCB (3), LED package (31), heat sink (4), chimney inlet (41), center opening (42), wings (43), electronic driver circuit (5), insulator (6), connection socket (7), circuit board housing (8), phosphor (9) and electricity insulation layer (10).

Figure 5:
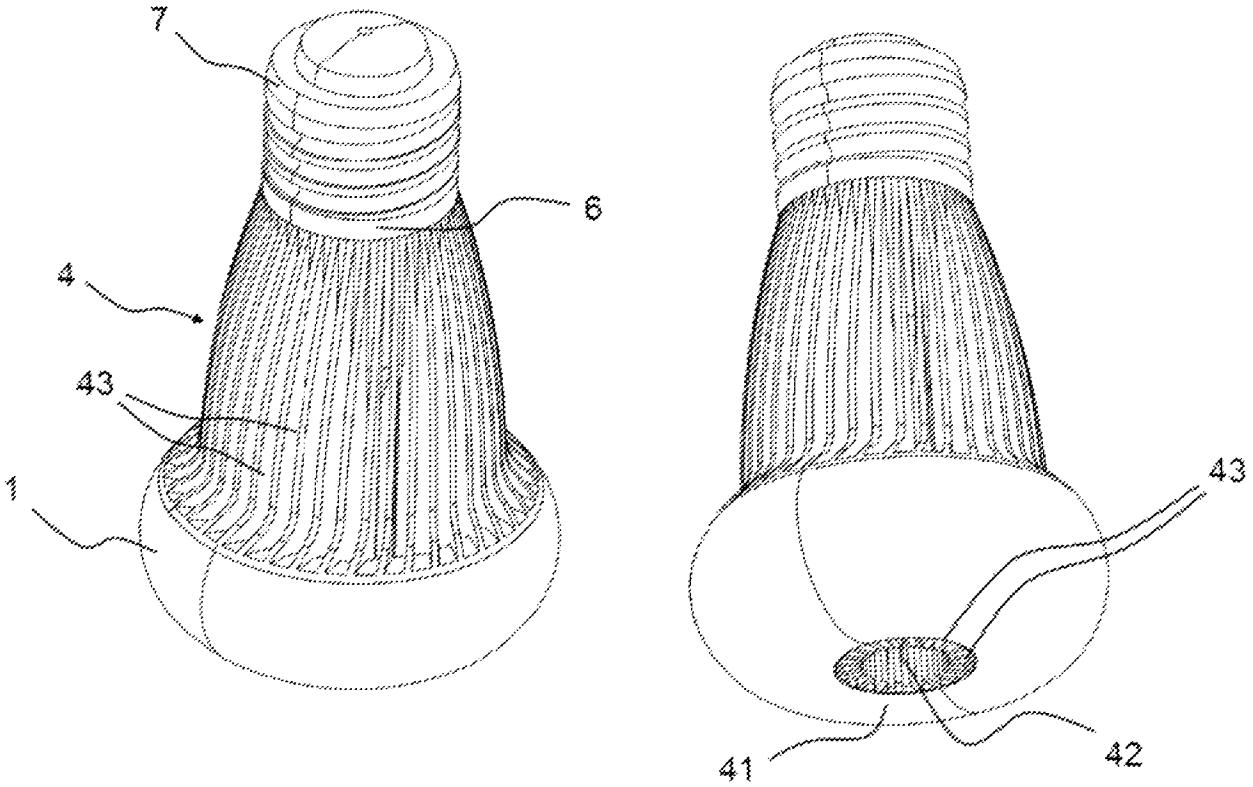
FIG. 5 is the top, bottom and external perspective view of the lighting system according to the present invention.

In the following, the features of the members comprised in the LED embodiment according to the present invention are described:

Diffuser (1): The diffuser (1) protects the LED chips in the LED package (2) and at the same time, diffuses the light emitted by LED chips that generate light by means of light diffusion in accordance with standards (FIG. 5).

Mounting plate (2): PCB (3) comprising LED package (31) thereon is attached on the mounting plate (2) (FIGS. 1 and 2). The connection between PCB (3) and mounting plate (2) is achieved by locking the holes provided on PCB (3) into the mounting rods (21) on the mounting plate (2). In addition, said connection can also be achieved by means of mounting methods such as screwing in the state of art.

Figure 6:
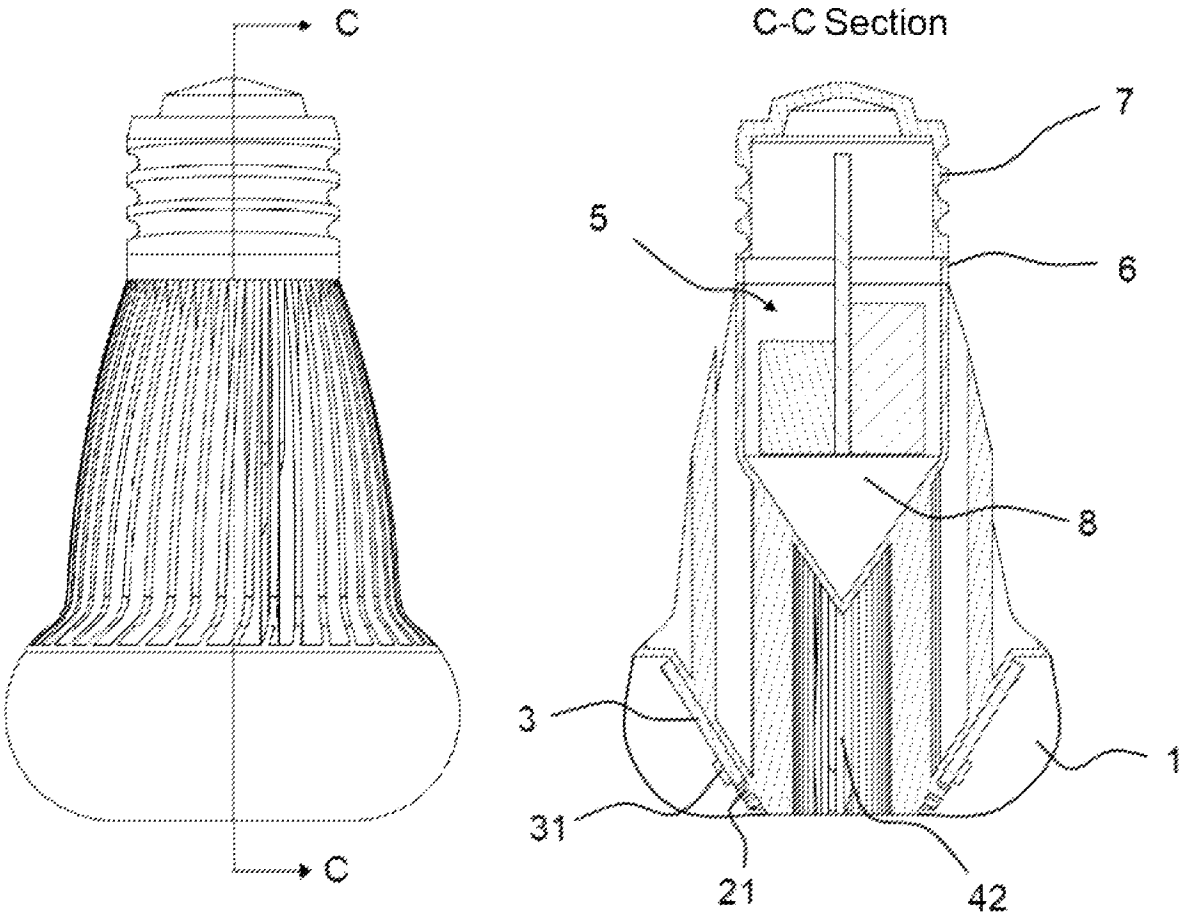
FIG. 6 is the perspective and sectional views of lighting system according to the present invention.

PCB (printed circuit board) (3): PCB (3) provides the thermal connection between heat sink (4) and LED package (31), electrical insulation and the transfer of electricity into the LED chip. Serial circuit between PCBs is connected to electronic driver circuit (5) through the PCB with holes and heat sink holes on mounting plate (2) and circuit board housing (8). (FIG. 6).

Electronic driver circuit (5): The electronic driver circuit (5) brings the electricity received from the connection socket to the desired electrical output for operating the LED packages (31) (FIG. 6). The electricity transmission between said electronic driver circuit (5) and LED package (31) is achieved by means of connection cables through heat sink holes and PCB with holes.

Figure 8:
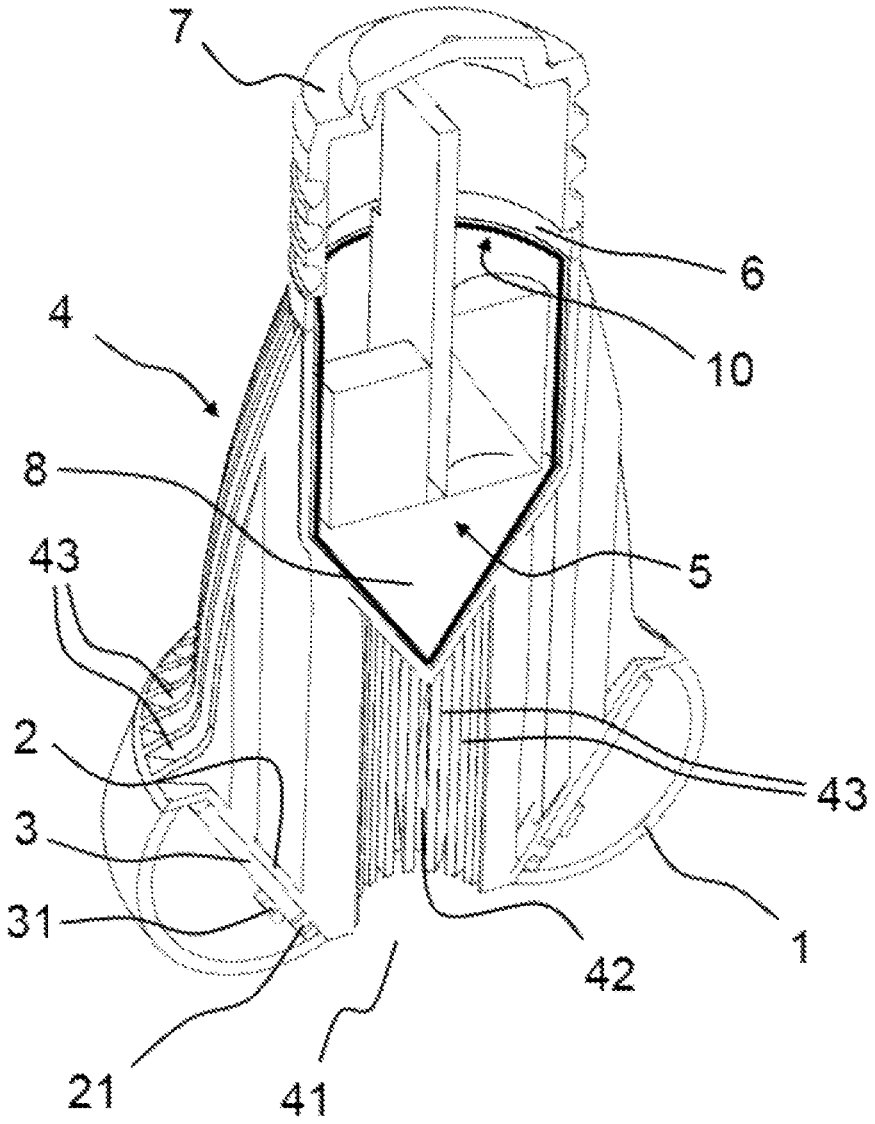
FIG. 8 is the sectional perspective view of lighting system according to the present invention.
Figure 9:
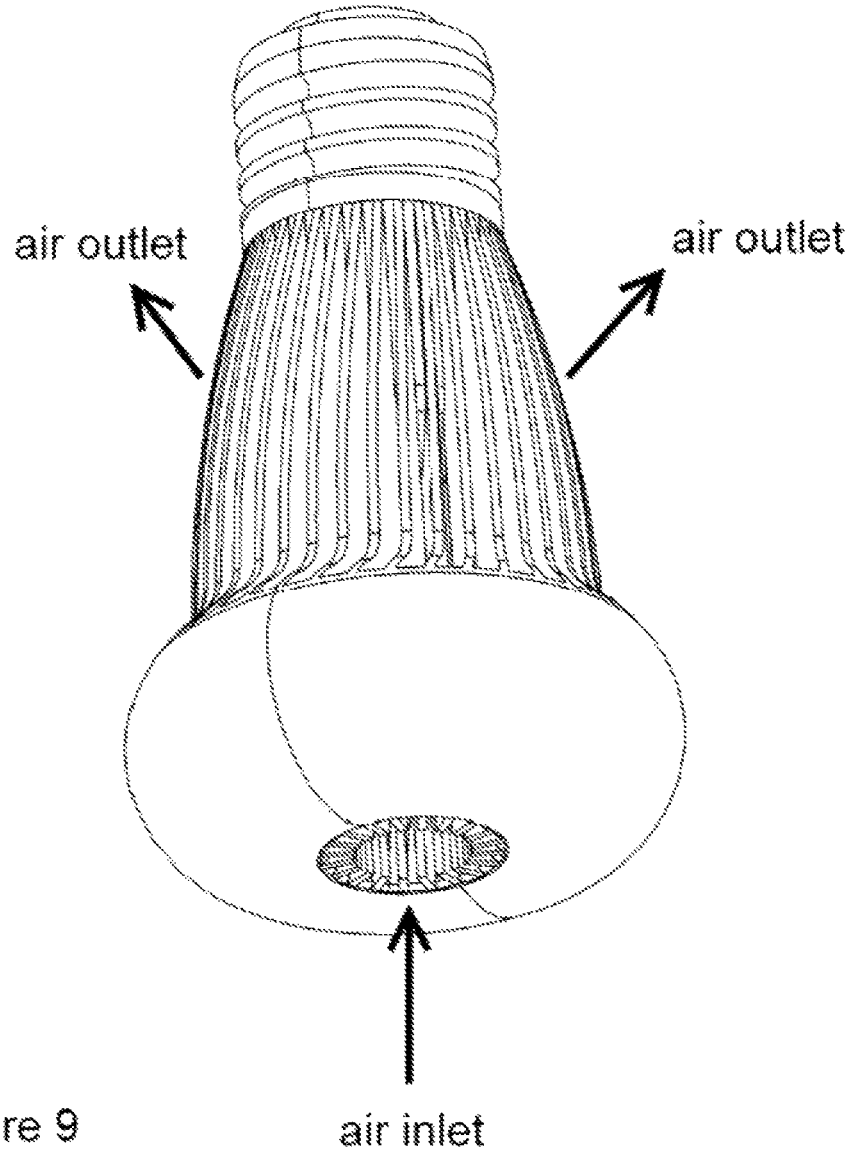
FIG. 9 is the drawing illustrating where the air input and air output are performed in the lighting system according to the present invention.

Insulator (6): The insulator (6) provides the thermal insulation between connection socket (7) and heat sink (4) (FIGS. 6 and 8).

Connection socket (7): The connection socket (7) is preferably Edison Base, wherein it is the section that provides the electricity transfer from electric source to the lighting system, meanly, the lamp (FIG. 5). The connection socket (7) matches with the other attachment systems known in the state of art. The lighting system according to the present invention can be applied to the standard indoor A19, Par38, PAR20, MR16, downlight and other similar lamps and are also suitable for other lamps with different form factors. Moreover, they are also suitable for both standard outdoor lamps and new-generation lamps.

In the lighting system according to the present invention, heat transfer area represents the center opening (42) in the middle of heat sink (4), the space between the heat sink fins (43) and all the surfaces with which heat sink fins (43) contact. The PCBs (3) on which LED packages (2) comprising LED chips, are placed are positioned on the heat sink base between diffuser (1) and fins (43). However, the circuit board on which other electronic circuit members operating the LED chips including the electronic driver circuit (5) is positioned, is placed within the circuit board housing (8) (FIG. 5).

Figure 7:
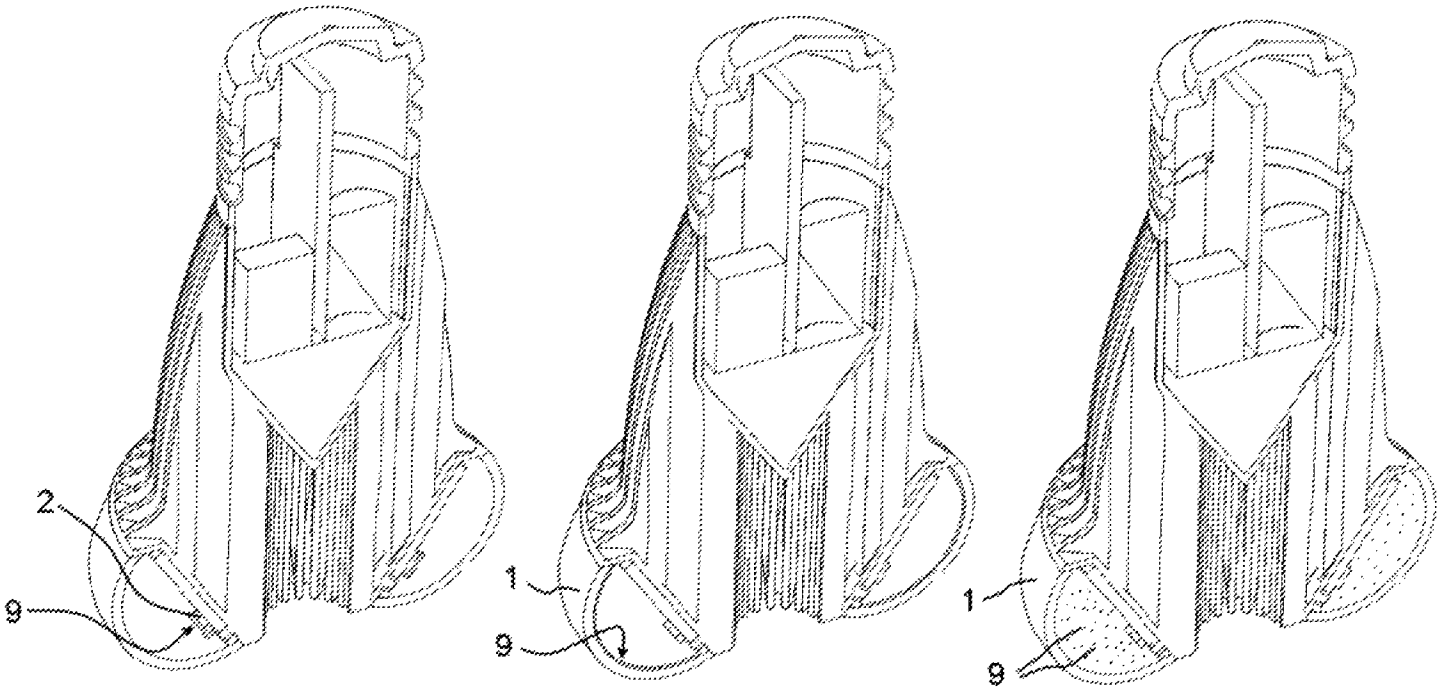
FIG. 7 is the drawings illustrating the several applications of phosphor in the lighting system according to the present invention.

Phosphor (9): Hot spots occur on the phosphor (9) that is the material regulating/controlling the light color and quantum efficiency (light volume) decreases. In the embodiment according to the present invention, phosphor (9) can be used in different manners. It can be distributed in the lower surface of diffuser (1) in some embodiments (FIG. 7—second drawing), on LED package (31) in some embodiments (FIG. 7—first drawing), and within the diffuser (1) in another embodiment (FIG. 7—third drawing). In addition, each of three conditions can also be applied in the same embodiment. The idea mentioned in this application comprises said three states of phosphor (9) and the other derivatives of said states, phosphor (9) can be present in the forms of layer or particle. In the embodiment according to the present invention, air cools both the LED package (31) comprising LED chip, and electronic driver circuit (5) and also the phosphor (9). Therefore, the problem of local hot spots occurring on the phosphor (9) is eliminated and the performance of light extraction can be increased by controlling the phosphor temperature.

Electricity insulation layer (10): Electricity insulation layer (10) provides the electrical insulation between heat sink (4) and electronic driver circuit (5) (FIG. 8). It prevents the contact of electronic driver circuit (5) with heat sink (4) made of metal material. Said insulation layer (10) can be applied in different ways between electronic driver circuit (5) and heat sink (4). Electricity insulation layer (10), for example, can be plastic plate. In addition, electrical insulation layer (10) can be created in the form of silicon, epoxy resin or polyurethane application between electronic driver circuit (5) and heat sink (4). Said application types can be achieved by means of impregnated type application via a tool such as air guns.

The main feature of lighting system distinguishing thereof from the lighting systems in the state of art is that it comprises chimney inlet (41) which is preferably cylindrical and has a center opening (42) increasing the contact surface of heat sink fins (43) with air, and in which the flowing air with a high volumetric flow rate enters into said center opening (42) (FIG. 1). Beyond increasing surface area, fin structure enables an effective radiative heat transfer beside the effective convective heat transfer. Thanks to said structure, chimney effect is created on the heat sink (4). In addition, positioning the PCBs (3) on which LED packages (31) are provided, angularly to the heat sink (4) rather than vertically (FIG. 1) is another feature distinguishing the lighting system according to the present invention from the other embodiments in the state of art. Angle of mounting plate (2) is so optimized that a very good light distribution is provided without exceeding the critical angle with vertical that limits the air flow rate. Moreover, the dome-shaped and elliptic diffuser (1) is also not provided in the state of art.

The lighting system according to the present invention provides continuity by feeding itself with the air flow it creates and increases the cooling capacity thanks to said chimney effect and vertical fins. The LED packages (31) are placed near the inlet section of center opening (42), in other words, near chimney inlet (41), and chimney effect is strengthened. In addition, the arrangement of LED packages (2) is different from the orders of LED package (2) placed on the smooth surface in the present systems. LED packages (31) are arranged with a specific geometry by being placed angularly to heat sink (4) fins (43). The heat can be diffused in a balanced manner on the wide heat sink (4) area thanks to PCBs (3) interconnecting the LED packages (2) prepared in accordance with the PCB (3) plane on which they are provided, and heat sink (4). Thanks to said new geometry, it is observed that high-temperature heating zone of each LED chip diffuses on a heat sink (4) base area increased in comparison with the base areas of present heat sink (4) base areas without intersecting with high-temperature heating zones of other LED packages (2). In the system according to the present invention, conductive thermal resistance is very low and this shows the effective heat transmission from heat sink base through heat sink fins. The chimney form created provides the heat sink (4) with surface area in an important area used for diffuser (1). Thanks to the facts that the diffuser (1) has dome shape, the heat sink (4) has geometry according to the present invention, and the air entering from the bottom flows in a regular manner without being subjected to a vital angle change, the heat transfer achieved by convection is increased.

In the lighting system according to the present invention, the cooling process is performed as follows: the air entering into the center opening (42) through the chimney inlet (41) contacts with the surfaces of heat sink (4) fins (43), which face the center opening (42), exchanges heat with the fins (43) and cools the fins (43). Fins are also cooled with radiative heat transfer thanks to its optimized fin structure for both convection and radiation. The cooled fins (43) cool the heated LED packages (2). However, the fins (43) release the heat they receive from LED packages (31) onto thereof, to the outer environment through the sections of heat sink (4), which remain outside. Therefore, LED packages (2) are cooled in a passive manner thanks to the form of heat sink (4). During cooling process, electronic driver circuit (5) and other electronic circuit members are also cooled in a similar manner with the cooling of LED packages (31).

The lighting system according to the present invention can be used for all kinds of LED lamps, wherein A19, PAR38, PAR20, MR16 and downlight lamps can be presented as examples. The lighting system according to the present invention can be applied in all LED and OLED based lighting systems.

In a preferred embodiment of the lighting system according to the present invention, said diffuser (1) has a structure that is bended towards the section of lighting system, which faces the outside.

Figure 10:
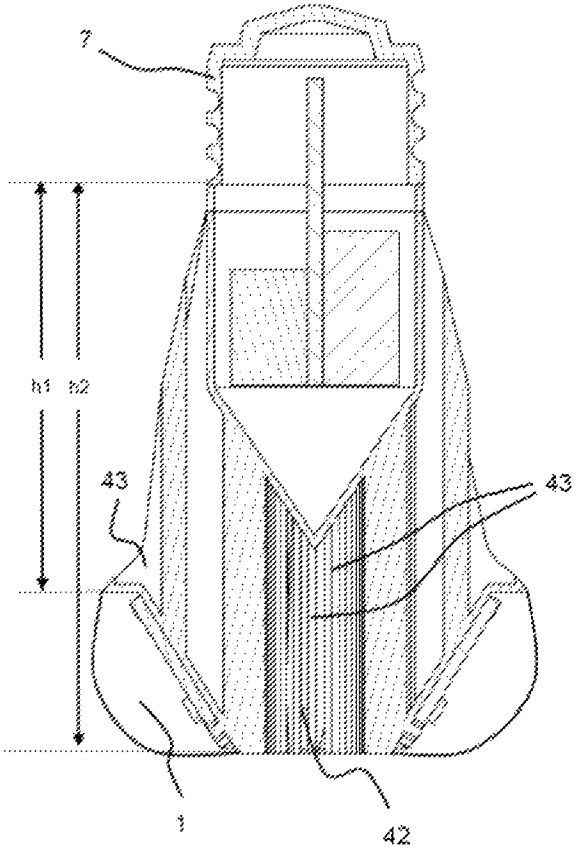
FIG. 10 is the sectional view of the preferred embodiment of the lighting system according to the present invention.

In a preferred embodiment of the lighting system according to the present invention:

the distance (h1) between said connection socket (7) and the place where heat sink fins (43) and diffuser (1) intersect in the section of lighting system, which faces the outside is shorter than;

the distance (h2) between said connection socket (7) and the place where the diffuser (3) intersects with the heat sink fins (43) in the section of heat sink fins (43), which face the center opening (42) (FIG. 10).

Figure 11:
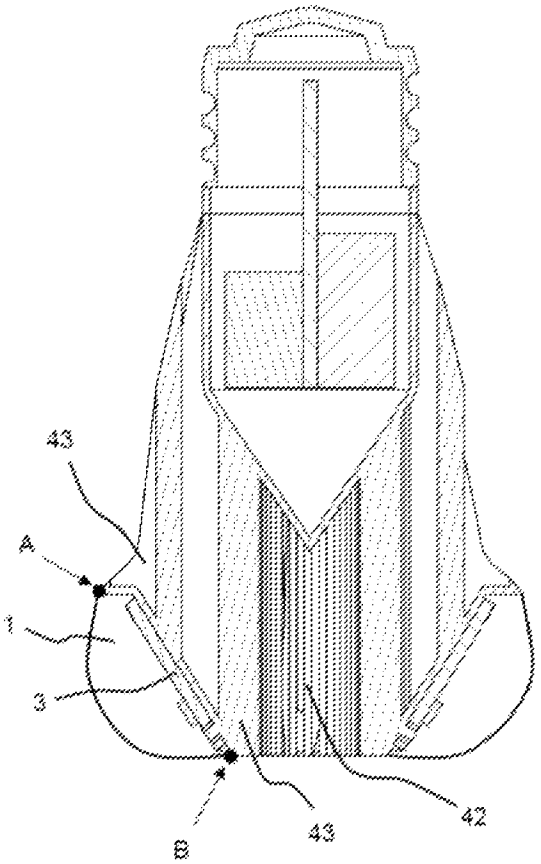
FIG. 11 is the sectional view of another preferred embodiment of the lighting system according to the present invention.

In a preferred embodiment of the lighting system according to the present invention, said mounting plate (2) is placed angularly between:

the place (A) where heat sink fins (43) and diffuser (l) intersect in the section of lighting system, which faces the outside;

the place (B) where the diffuser (3) intersects with the heat sink fins (43) in the section of heat sink fins (43), which face the center opening (42) (FIG. 11).

In a preferred embodiment of the lighting system according to the present invention, said heat sink fins (43) extend between the place where the circuit board housing (8) intersects with the heat sink fins (43), and chimney inlet in the section facing said center opening (42).

In a preferred embodiment of the lighting system according to the present invention, said heat sink fins (43) extend between insulator and diffuser in the section of lighting system, which faces the outside.

In the preferred embodiment of the present invention, heat sink (4) is made of metal or a material such as graphite and graphene with a high thermal conductivity.

In the preferred embodiment of the present invention, LED chips to be placed onto light motor have both chip on board and package on board features.

We claim:

1. A lighting system comprising:

an LED package having LEDs that generate light;

a diffuser cooperative with said LED package so as to diffuse the light generated by said LED package and so as to protect said LEDs;

a connection socket adapted to transmit electricity;

an electronic driver circuit electrically connected to said connection socket and to said LEDs so as to convert electricity from said connection socket to an electrical output that operates said LEDs and to limit current to said LEDs;

a phosphor cooperative with said LED package that regulates light emitted from said LEDs;

a heat sink comprising:

a plurality of heat sink fins cooperative with said LED package and said electronic driver circuit and said phosphor so as to remove heat therefrom by natural convection and by thermal radiation;

a center opening passing through said plurality of heat sink fins from a heat sink base to a circuit board housing, said center opening adapted to contact the heat generated by said LED package and said electronic driver circuit and said phosphor; and a chimney inlet cooperative with said center opening so as to allow air to enter said center opening;

a mounting plate having a first end positioned adjacent to said chimney inlet and a second end positioned adjacent to a location where said plurality of heat sink fins and said diffuser intersect; and a printed circuit board (PCB) mounted on said mounting plate, the PCB having said LED package placed thereon and positioned adjacent to the chimney inlet so as to interconnect said LED package and said heat sink.

2. The lighting system of claim 1, said diffuser having a dome shape.

3. The lighting system of claim 1, said mounting plate located under said PCB and positioned angularly to said heat sink so as to decrease optic losses and to improve light distribution.

4. The lighting system of claim 1, said connection socket adapted to supply electricity to downlight lamps.

5. The lighting system of claim 1, said center opening having a cylindrical shape.

6. The lighting system of claim 1, the lighting system being applied to LED or OLED lighting systems.

7. The lighting system of claim 1, said plurality of heat sink fins extending between an insulator and said diffuser.

8. The lighting system of claim 1, said plurality of heat sink fins extending between a housing of said PCB and said chimney inlet.

9. The lighting system of claim 1, said mounting plate angularly positioned between said diffuser and said center opening.

10. The lighting system of claim 9, said distance between said connection socket and a location where said plurality of heat sink fins and said diffuser intersect so as to face outwardly is less than a distance between said connection socket and a location where said diffuser intersects said plurality of heat sink fins which face said center opening.

11. The lighting system of claim 1, said diffuser having a structure encircling a portion of said center opening so as to guide air flow into said chimney inlet.

12. The lighting system of claim 1, said phophor positioned at a location selected from the group consisting of a lower surface of said diffuser, on said LED package, within said diffuser, and a combination thereof.

13. The lighting system of claim 1, further comprising:

an electrical insulating layer positioned between said heat sink and said electronic driver circuit, said electrical insulating layer having a conical portion located at least partially within said center opening.

14. The lighting system of claim 13, said electrical insulating layer comprised of silicon, epoxy resin or polyurethane.

15. The lighting system of claim 1, further comprising:

a plurality of mounting rods formed on a mounting plate, said plurality of mounting rods attached into holes formed on said PCB so as to connect said mounting plate to said PCB.

16. The lighting system of claim 1, said heat sink formed of a metal material, a graphite material, or a graphene material.

17. The lighting system of claim 1, said plurality of LEDs having either chip-on-board or package-on-board.

18. A lighting system comprising:

a printed circuit board (PCB);

an LED package placed on said PCB, said LED package having a plurality of LEDs;

a diffuser cooperative with said LED package so as to diffuse the light generated by said plurality of LEDs and so as to protect said LEDs;

a connection socket adapted to transmit electricity;

an electronic driver circuit electrically connected to said connection socket and to said LEDs so as to convert electricity from said connection socket to an electrical output that operates said LEDs and to limit current to said LEDs;

a phosphor cooperative with said LED package that regulates light emitted from said LEDs;

a heat sink comprising:

a plurality of heat sink fins cooperative with said LED package and said electronic driver circuit and said phosphor so as to remove heat therefrom by natural convection and by thermal radiation;

a center opening passing through said plurality of heat sink fins from a heat sink base to a circuit board housing, said center opening transferring heat from said plurality of LEDs and said electronic driver circuit and said phosphor to air; and a chimney inlet cooperative with said center opening so as to allow air to enter into said center opening; and a mounting plate having a first end positioned adjacent to said chimney inlet and a second end positioned adjacent to a location where said plurality of heat sink fins and said diffuser intersect, said PCB mounted on said mounting plate such that said LED package is positioned adjacent to said chimney inlet.

19. The lighting system of claim 18, said PCB having a housing with a conical section that is positioned at least partially within said center opening so as to guide air flow.

20. The lighting system of claim 18, said diffuser having a dome shape, said center opening passing through said diffuser.

21. The lighting system of claim 18, said center opening having a cylindrical shape so as to guide air flow and to remove heat.

22. The lighting system of claim 18, further comprising:

an electrical insulating layer positioned between said heat sink and said electronic driver circuit, said electrical insulating layer having a conical section positioned at least partially within said center opening.

* * * * *